United States Patent [19]

Seering et al.

[11] Patent Number: 4,836,824

[45] Date of Patent: Jun. 6, 1989

[54] PRENATAL CRADLE

[76] Inventors: Christine L. Seering, 6659 Poplar, Box 443, Hamburg, Mich. 48139; Mona E. Seering, P.O. Box 688, Webberville, Mich. 48892

[21] Appl. No.: 170,746

[22] Filed: Mar. 21, 1988

[51] Int. Cl.[4] ..... A41C 1/08; A41D 1/20

[52] U.S. Cl. ..... 450/155

[58] Field of Search ..... 450/155, 2, 3, 4, 6, 450/7, 14, 15, 16, 19

[56] References Cited

U.S. PATENT DOCUMENTS

| | | | |
|---|---|---|---|
| 284,831 | 9/1883 | Galny | 450/155 |
| 880,444 | 2/1908 | Donaldson | 450/155 |
| 1,828,015 | 10/1931 | Allebach | 450/155 |
| 1,983,636 | 12/1934 | Palkens | 450/155 |
| 3,273,563 | 9/1966 | Bonang | 450/155 |

*Primary Examiner*—Werner H. Schroeder
*Assistant Examiner*—Jeanette E. Chapman
*Attorney, Agent, or Firm*—Brooks & Kushman

[57] ABSTRACT

A prenatal cradle (10) for supporting a baby, surrounding amniotic fluid, and associated matter in a pregnant woman's uterus (12) by redistributing around the hips (14, 16), torso and lower back (22) downward and forward pressures exerted by the baby and relieving strain on the woman's lower back (22), abdomen (24), and groin area (26). The prenatal cradle (10) includes an adjustable womb band (28) for supporting the uterus (12), and a pair of torso bands (36, 38) for redistributing the uterine weight across the torso. Connecting the womb band (28) to the pair of torso bands (36, 38) is a pair of associated side members (76, 78) which distribute the uterine weight around the trunk of the woman, separating the torso bands (36, 38) and exposing the abdomen (24) to relieve groin pressure without imposing constricting inward pressure on the uterus (12). The prenatal cradle also provides a method for ease of removal during Braxton Hicks contractions by loosening and positioning the front portion (30) of the womb band (28) above the uterus (12), returning the womb band (28) below the uterus (12) when the contractions have subsided.

13 Claims, 1 Drawing Sheet

PRENATAL CRADLE

TECHNICAL FIELD

This invention relates to female apparel which has particular utility by pregnant women to support and redistribute uterine weight, especially during the third trimester.

BACKGROUND ART

Various types of apparel have previously been utilized by pregnant women in order to alleviate problems associated with a growing uterus which accompanies pregnancy. Such problems include back pain, discomfort from pelvic pressure, and the development of incorrect posture, together with attendant and associated difficulties.

Back ache arises because during pregnancy, the usually stable joints of the pelvis begin to loosen up to allow easier passage for the baby at delivery. This, along with an oversized abdomen, throws a woman's body off balance. To compensate, the woman tends to bring her shoulders back and thrust her neck forward. Standing with her belly thrust forward compounds the problem. The result is a deeply-curved lower back, strained back muscles, and pain.

As pregnancy progresses, the woman's center of gravity changes as her weight and shape change. As the center of gravity moves further forward, lower back muscles must work harder to support the spine since stomach muscles are already distended. As her abdomen enlarges, the woman may try to compensate by leaning backward to correct her balance, especially when walking.

Other problems associated with pregnancy include frequent urination. One reason for this is the higher volume of body fluids and the improved efficiency of the kidneys, which helps rid the wonam's body more quickly of waste products. Another problem arises from the pressure of the growing uterus, which is located in the pelvis next to the bladder. The need to urinate frequently is often accompanied by difficulties associated with removing undergarments.

As a temporary relief to problems associated with back pain and uterine weight, a pregnant woman often adopts a hands clasping stance. In this position, the woman joins her hands by intertwining her fingers below the uterus and exerts upward pressure on the uterus through the wrists and arms toward her shoulders. Additional temporary measures include the pregnant woman adopting a stance where her hands are placed across her back at the waist in an effort to relieve lower back pain. These measures, however, at best afford only temporary relief.

Conventional approaches to the above problems are disclosed in, for example, U.S. Pat. Nos. 2,462,195; 2,905,947; and 3,694,816.

DISCLOSURE OF THE INVENTION

An object of the present invention is to provide an undergarment for use by a pregnant woman which supports her lower back and helps redistribute forward uterine weight.

Further, an object of the present invention is to provide a device which need not be removed for toileting, thus avoiding perineal irritation due to moisture retention.

It is also an objective of the present invention to provide uterine support without restricting the buttocks, crotch, abdomen, or legs while allowing free movement of arms, hands, and legs thereby promoting free blood flow therewithin.

Another object of the present invention is to encourage correct posture in the pregnant woman.

Moreover, an additional object of the present invention is to provide a method for easy removal of the support to the uterus when it seems to bunch up and harden. Known as Braxton Hicks contractions, these usually begin to rehearse the pregnant uterus for labor sometime during the latter half of pregnancy. These occur while the uterus is flexing its muscles, practicing and preparing itself for the contractions which will take place during labor and delivery of the baby. Though these contractions may be painless, they may possibly produce an uncomfortable tightening of the uterus, beginning at the top and gradually spreading downward before relaxing. The contractions last about thirty seconds, but may last as long as two minutes or more. As pregnancy draws to a close in the ninth month, Braxton Hicks contractions begin to be more frequent, intense, and painful. Accordingly, it would be helpful if an undergarment were available which would be readily removable when painful symptoms occur which often accompany such contractions. Under prevailing approaches to the problem thus far available, such as a tummy sling or panty girdle, the undergarment is not easily removed the onset of such contractions. Thus, the discomfort continues unabated.

Finally, an object of the present invention is to provide an undergarment which, while allowing freedom of movement, can readily be worn beneath the woman's lingerie without having to be removed whenever such nether garments are worn.

In carrying out the above objects, a prenatal cradle includes a womb band for supporting the uterus, a pair of torso bands for redistributing the uterine weight across the torso, and a pair of side members connecting the womb band to the associated torso band.

In the preferred embodiment of the prenatal cradle, the womb band includes a front portion and an elongate rear portion, the womb band encircling the woman below the uterus and extending upwardly over the hips and the lower back to provide support to the lower back when the woman is standing or ambulatory. Each torso band has an elongate front portion with a lower end secured to the womb band proximate an associated hip, the front portion of each torso band extending diagonally and crossing below and between the breasts without interfering with their normal or natural position. Connected to the elongate front portion of each torso band is a shoulder portion which distributes the uterine weight over the woman's torso and lower trunk. An elongate back portion connects the associated shoulder portion to the rear portion of the womb band to provide lift to the womb band opposing the uterine weight.

A pair of side members separates the torso bands which expose the abdomen and distribute uterine weight at waist level without imposing constricting inward pressure on the uterus. Each side member links an associated torso band and the rear portion of the womb band to relieve back discomfort and to encourage correct posture while allowing free movement of the arms and legs.

The objects, features, and advantages of the present invention are readily apparent from the following detailed description of the best mode for carrying out the invention when taken in connection with the accompanying drawing.

BEST MODE FOR CARRYING OUT THE INVENTION

Figure 1:
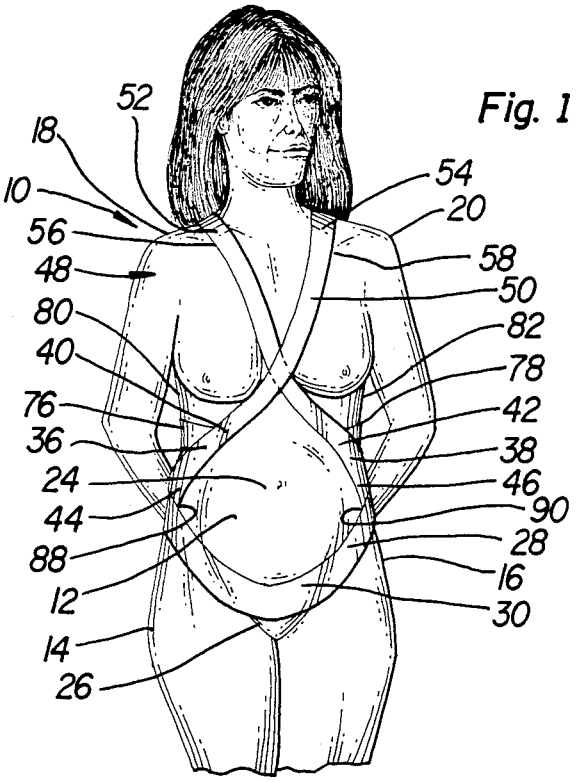
FIG. 1 is a front perspective view of a prenatal cradle constructed in accordance with the present invention.

With reference to the drawing, a prenatal cradle 10 according to the present invention supports a baby, including amniotic fluid, etc. in a pregnant woman's uterus 12 by redistributing around the hips 14, 16 and torso downward and forward pressures exerted by the pregnancy and relieving strain on the woman's lower back 22, abdomen 24 and groin area 26.

Figure 2:
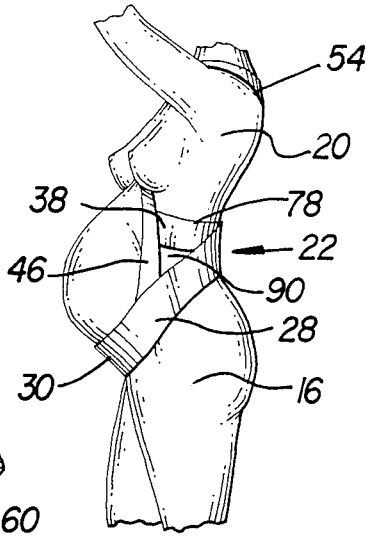
FIG. 2 is a side perspective view of the prenatal cradle of the present invention.

Turning first to FIGS. 1 and 2, there is shown a womb band 28 for supporting the uterus 12. The womb band 28 has a front portion 30 and an elongate rear portion 32 in which there is a center section 34. Encircling the woman below the uterus 12 and extending upwardly over the hips 14, 16 and the lower back 22, the womb band 28 provides support to the lower back 22 when the woman is standing or ambulatory.

For redistributing uterine weight across the torso, a pair of torso bands 36, 38 is provided. Each has an elongate front portion 40, 42, including a lower end 44, 46 and an upper end 48, 50. The lower end 44, 46 of the front portion 40, 42 is secured to the womb band 28 proximate the associated hip 14, 16. Crossing below and between the breasts, the front portion 40, 42 of each torso band 36, 38 distributes the uterine weight without interfering with the breasts. Joining the upper end 48, 50 of each front portion 40, 42 is an elongate shoulder portion 52, 54 which distributes the uterine weight across the shoulders 18, 20. Each shoulder portion 52, 54 has a front section 56, 58 and a back section 60, 62, each front section 56, 58 being connected to the upper end 48, 50 of the front portion 40, 42 of the associated torso band 36, 38.

Figure 3:
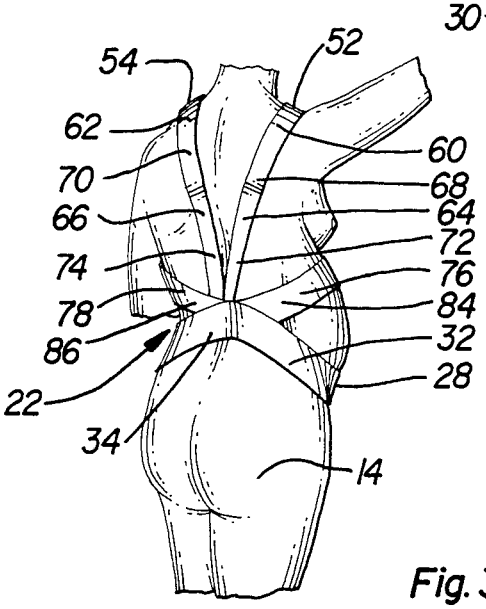
FIG. 3 is a rear quarter perspective view of the prenatal cradle of the present invention.

With reference to FIG. 3, extending upwardly from the woman's lower back 22 is an elongate back portion 64, 66 of each torso band which includes an upper section 68, 70 and a lower section 72, 74. The upper section 68, 70 of the back portion 64, 66 is connected to the back section 60, 62 of the associated shoulder portion 52, 54. For securement to the center section 34 of the rear portion 32 of the womb band 28, each elongate back portion 64, 66 also includes a lower 35 section 72, 74. Thus, the upper section 68, 70 of the back portion 64, 66 is connected to the back section 60, 62 of the associated shoulder portion 52, 54. The lower section 72, 74 is secured to the center section 34 of the womb band 28 to provide lift to the womb band 28 opposing the weight of the uterus 12.

Turning back to FIGS. 1 and 2, a pair of side members 76, 78 separates the torso bands 36, 38 and exposes the abdomen 24 to relieve pressure in the lower groin area without imposing constricting inward pressure on the uterus 12. Thus, each side member 76, 78 distributes the uterine weight around the trunk of the woman. Each side member 76, 78 includes a forward end 80, 82 secured to the lower end 44, 46 of the front portion 40, 42 of the associated torso band 36, 38. Also included in each side member 76, 78 is a rearward end 84, 86 which is secured to the center section 34 of the womb band 28 to relieve back pain and to encourage correct posture, yet allowing free movement of the arms and legs.

In the preferred embodiment illustrated, the lower end 44, 46 of the front portion 40, 42 of each torso band 36, 38 is secured to the front portion 30 of the womb band 28 at an acute included angle 90. Thus, the uterine weight is opposed by each torso band 36, 38 upwardly and laterally away from the uterus 12 toward each associated hip 14, 16.

In keeping with the invention, the womb band 28 is elastic to provide comfort and adjustable support to the woman around the lower abdomen 24.

Continuing with reference to FIG. 2, in order to adjust the womb band 28, the woman pulls the womb band 28 near points 88, 90. When support is not desired or required, the front portion 30 of the womb band 28 is adjustable downwardly by exerting downward pressure on the womb band 28 near points 88 and 90.

In the preferred construction, the womb band 28 is between about 2-inches and about 5-inches wide to distribute the upward force exerted by the womb band 28 opposing the uterine weight across the width of the womb band 28.

Preferably, each torso band 36, 38 is between about 1-inch and about 2-inches wide to distribute the downward uterine weight transmitted by each torso band 36, 38 across the associated shoulder 18, 20 without discomfort. Preferably, each side member 76, 78 is between about 1.5-inches and about 3-inches wide to distribute comfortably around the associated hip 14, 16 pressure exerted by the associated torso band 36, 38.

The present invention is also concerned with a method for supporting a fetus, amniotic fluid and associated matter in the pregnant woman's uterus 12 by redistributing around the hips 14, 16 and shoulder 18, 20 pressures exerted by the baby while relieving strain on the woman's lower back 22, abdomen 24, and groin area 26. The method includes the steps of positioning a womb band 28 for supporting the uterus 12 below the uterus 12. The pair of torso bands 36, 38 is then deployed over the shoulders 18, 20 which redistributes uterine weight across the torso. Pursuant to the invention, securing the pair of side members 76, 78 between the womb band 28 and the associated torso bands 36, 38 separates the torso bands 36, 38 and exposes the abdomen 24 to relieve pressure in the groin areas without imposing constricting inward pressure on the uterus 12.

In order to adjust the prenatal cradle 10, an upward pull is exerted proximate the womb band 28 and the associated torso band near points 88, 90. The prenatal cradle 10 may also be loosened by a downward tug exerted in the same area.

The present invention is also concerned with providing a method for easy removal of womb support during Braxton Hicks contractions. After the contractions subsided, the womb band 28 is deployed below the uterus 12 to provide support thereto.

Thus, it is apparent that there has been provided in accordance with the invention a prenatal cradle that fully satisfies the objects, aims, and advantages set forth above. While the best mode for carrying out the invention has been described in detail, those familiar with the art to which this invention relates will recognize alternative ways of practicing the invention as defined by the following claims.

What is claimed is:

1. A prenatal cradle for supporting forward weight of pregnancy in a pregnant woman's uterus by redistributing around the hips and shoulders downward and forward pressures exerted by the baby and relieving strain on the woman's lower back, abdomen, and groin area, the prenatal cradle comprising:

a womb band for supporting the uterus, the womb band having:

a front portion which is positioned so as to allow unlimited growth of the uterus, and an elongate rear portion of approxiamtely equal width to the front portion, the elongate rear portion including a center section, the womb band encircling the woman below the uterus and extending upwardly over the hips and the lower back to provide support which is distributed across the uterus and lower back when the women is standing or ambulatory;

a pair of torso bands for redistributing uterine weight across the torso, each having:

an elongate front portion including a lower end and an upper end, the lower end of the front portion being secured to the womb band proximate the associated hip, the front portion of each torso band extending diagonally and crossing below and between the breasts to distribute uterine weight without interfering with the breasts, an elongate shoulder portion, including a front section and a back section, the front section being connected to the upper end of the front portion of the associated torso band, and an elongate back portion including an upper section and a lower section, the upper section of the back portion being connected to the back section of the associated shoulder portion, the lower section being secured to the center section of the womb band for securement to the rear portion of the womb band and to provide lift to the womb band opposing the uterine weight; and a pair of side members to distribute the uterine weight around the trunk of the woman, separating the torso bands and exposing the abdomen to relieve pressure in the lower groin without imposing constricting inward pressure on the uterus, each side member, including:

a forward end secured to the lower end of the front portion of the associated torso band, and a rearward end secured to the center section of the rear portion of the womb band to help relieve back pain and to encourage correct posture, allowing free movement of the arms and legs.

2. The prenatal cradle of claim 1 wherein the lower end of the front portion of each torso band is secured to the front portion of the womb band at an acute included angle so that uterine weight is opposed by each torso band upwardly and laterally away from the uterus toward each associated hip.

3. The prenatal cradle of claim 1 wherein the womb band is elastic to provide comfort and adjustable support to the woman around the lower abdomen.

4. The prenatal cradle of claim 1 herein the womb band is adjustable upwardly by upward movement of the womb band.

5. The prenatal cradle of claim 1 wherein the womb band is adjustable downwardly by downward movement of the womb band.

6. The prenatal cradle of claim 1 wherein the womb band is of constant width, the width being between about 2 inches and about 5 inches to distribute upward pull exerted by the womb band opposing the uterine weight across the width of the womb band.

7. The prenatal cradle of claim 1 wherein each torso band is between about 1 inch and about 2 inches wide to distribute the downward uterine weight transmitted by each torso band across the torso without discomfort.

8. The prenatal cradle of claim 1 wherein each side member is between about 1.5 inches and about 3 inches wide to distribute comfortably around the associated side pull exerted by the associated torso band.

9. A method for supporting a baby, surrounding amniotic fluid, and associated matter in a pregnant woman's uterus by redistributing around the hips and shoulders downward and forward pressures exerted by the baby and relieving strain on the woman's lower back, abdomen, and groin area, comprising the steps of:

positioning a womb band for supporting the uterus below the uterus, the womb band having:

a front portion, and an elongate rear portion including a center section, the womb band encircling the woman below the uterus and extending upwardly over the hips and the lower back to provide support to the lower back when the woman is standing or ambulatory;

deploying a pair of torso bands for redistributing uterine weight across the torso, each having:

an elongate front portion including a lower end and an upper end, the lower end of the front portion being secured to the womb band proximate the associated hip, the front portion of each torso band extending diagonally and crossing below and between the breasts to distribute uterine weight without interfering with the breasts, an elongate shoulder portion to distribute the uterine weight throughout the torso, each shoulder portion including a front section and a back section, the front section being connected to the upper end of the front portion of the associated torso band, and an elongate back portion including an upper section and a lower section, the upper section of the back portion being connected to the back section of the shoulder portion, the lower section being secured to the center section of the womb band for securement to the rear portion of the womb band and to provide lift to the womb band opposing the uterine weight; and securing a pair of side members to the associated torso bands distribute the uterine weight around the trunk of the woman, separating the torso bands and exposing the abdomen to relieve pressure in the groin area without imposing constricting inward pressure on the uterus, each side member, including:

a forward end secured to the lower end of the front portion of the associated torso band, and a rearward end secured to the center section of the rear portion of the womb band to help relieve back pain and to encourage correct posture, allowing free movement of the arms and legs.

10. The method of claim 9 further including the step of adjusting the prenatal cradle by an upward pull exerted on the womb band near the point of intersection with the associated torso band.

11. The method of claim 10 further including the step of loosening the prenatal cradle by a downward tug exerted proximate the womb band and the associated torso band.

12. A method for easy removal of a supportive structure during Braxton-Hicks contractions and for supporting a baby in a pregnant woman's uterus by redistributing around the hips and torso downward and forward pressures exerted by uterine weight and relieving strain on the woman's lower back, abdomen, and groin area, comprising the steps of:

positioning a womb band above the uterus, the womb band having:

a front portion, and an elongate rear portion including a center section, the womb band encircling the woman below the uterus and extending upwardly over the hips and the lower back to provide support to the lower back when the woman is standing or ambulatory;

deploying a pair of torso bands for redistributing uterine weight across the torso, each having:

an elongate front portion including a lower end and an upper end, the lower end of the front portion being secured to the womb band proximate the associated hip, the front portion of each torso band extending diagonally and crossing below and between the breasts to distribute uterine weight without interfering with the breasts, an elongate shoulder portion to distribute the uterine weight across the torso, each shoulder portion including a front section and a back section, the front section being connected to the upper end of the front portion of the associated torso band, and an elongate back portion including an upper section and a lower section, the upper section of the back portion being connected to the back section of the shoulder portion, the lower section being secured to the center section of the womb band for securement to the rear portion of the womb band and to provide lift to the womb band opposing the uterine weight; and securing a pair of side members to the associated torso bands distribute the uterine weight around the trunk of the woman, separating the torso bands and exposing the abdomen to relieve pressure in the groin areas without imposing constricting inward pressure on the uterus, each side member, including:

a forward end secured to the lower end of the front portion of the associated torso band, and a rearward end secured to the center section of the rear portion of the womb band to help relieve back pain and to encourage correct posture, allowing free movement of the arms and legs.

13. The method of claim 12 further including the step of deploying the womb band below the uterus to restore support thereto when the contractions are over.

* * * * *